US006460474B1

(12) United States Patent
Nishi

(10) Patent No.: US 6,460,474 B1
(45) Date of Patent: Oct. 8, 2002

(54) SIDE CUTTER FOR SEWING MACHINE

(75) Inventor: Saburo Nishi, Sanjo (JP)

(73) Assignee: Nishi Manufacturing Co., Ltd., Niigata Pref. (JP)

( * ) Notice: Subject to any disclaimer, the term of this patent is extended or adjusted under 35 U.S.C. 154(b) by 0 days.

(21) Appl. No.: 09/977,357

(22) Filed: Oct. 16, 2001

(30) Foreign Application Priority Data

Jul. 10, 2001 (JP) ..... 2001-004539

(51) Int. Cl.[7] ..... D05B 37/04
(52) U.S. Cl. ..... 112/129
(58) Field of Search ..... 112/129, 128, 112/122, 153

(56) References Cited

U.S. PATENT DOCUMENTS 2,021,700 A * 11/1935 Pugach ..... 112/128
2,443,369 A * 6/1948 Alifano et al. ..... 112/128
4,572,089 A * 2/1986 Nishi ..... 112/128
4,984,525 A * 1/1991 Mori ..... 112/128

* cited by examiner

*Primary Examiner*—Ismael Izaguirre
(74) *Attorney, Agent, or Firm*—Wenderoth, Lind & Ponack, L.L.P.

(57) ABSTRACT

A side cutter for a sewing machine enables the sewing machine to carry out sewing and cutting of cloth irrespective of its thickness and can be attached and detached to and from the sewing machine body easily and speedily. The side cutter 50 for a sewing machine has a holder coupling section 69 formed behind a presser foot 53 located under a frame body 52, and a link frame 56 is attached to the frame body 52 to transmit a vertical movement of a sewing machine needle to movable blade 55. The movable blade 55 is fixed to a lower front end portion of the link frame 56 through a spring washer 70.

5 Claims, 4 Drawing Sheets

Fig. 6 - PRIOR ART

Fig. 7 - PRIOR ART
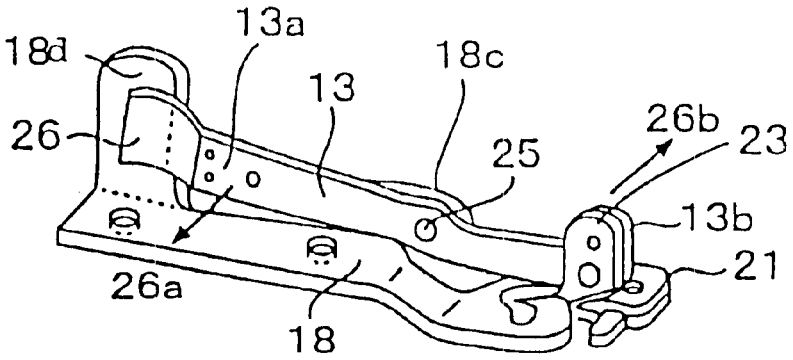

SIDE CUTTER FOR SEWING MACHINE

BACKGROUND OF THE INVENTION

The present invention relates to a side cutter to be attached to a sewing machine for facilitating hemstitching by the sewing machine.

DESCRIPTION OF THE RELATED ART

Side cutters for facilitating hemstitching by sewing machines have so far been developed, and Japanese Patent No. 2839510 proposes an invention for preventing crosswise run-out of a movable blade in a side cutter. The side cutter 100 has a tabular base plate 1 and a vertical section 1*a* rising therefrom and is designed to be attached to a sewing machine by fixing a front end portion 2 of the vertical section 1*a* of the base plate 1 to a presser bar 3 of the sewing machine with a thumbscrew 4, as shown in FIG. 6.

The side cutter 100 has a presser foot 18 attached to the lower side of the base plate 1, a fixed blade 21 attached to a front end portion of the presser foot 18 and a movable blade 23 located above the fixed blade 21. The movable blade 23 cuts cloth in cooperation with the fixed blade 21. The base plate 1 has in its vertical section 1*a* a working lever 5, which transmits the vertical movement of a sewing machine needle to the movable blade 23 through a lever 13 to be described later.

As shown in FIG. 7, the presser foot 18 supports, in its vertical section 18*c* formed in the middle thereof, the lever 13 with a supporting shaft 25 so that the lever 13 can swing vertically. Meanwhile, a leaf 26 is attached to a rear end portion 13*a* of the lever 13. This leaf 26 is brought into plane contact with a lateral side of a vertical section, 18*d* formed in the rear end portion of the presser foot 18 to urge the lever 13 in the horizontal direction as indicated by the arrow 26*a*.

Thus, the movable blade 23, which is fixed to a front end portion 13*b* of the lever 13, reciprocates vertically pushing the cutting edge of the fixed blade 21 in the horizontal direction indicated by the arrow 26*b* to cut cloth.

However, the side cutter 100 for a sewing machine involves the problem that the mechanism containing the lever 13, the leaf 26 and the like incorporated to ensure shear force required in cutting cloth by bringing the movable blade 23 into contact with the cutting edge of the fixed blade 21 is complicated and it entails great trouble and cost in manufacturing it.

Meanwhile, operations of attaching and detaching the side cutter 100 to and from the sewing machine are intricate and take much time, since its vertical section 1*a* of the base plate 1 must be fastened at the front end portion 2 with the thumbscrew 4 to the presser bar 3 of the sewing machine.

The present invention is directed to providing a side cutter for a sewing machine having overcome the problems inherent in the prior art as described above, which is small-sized and simple-structured and yet can securely achieve shearing of cloth and which can be attached and detached to and from a sewing machine speedily and securely.

SUMMARY OF THE INVENTION

The gist of the present invention resides in a side cutter for a sewing machine, the side cutter comprising a fixed blade located in front of a frame body; a link frame attached to the frame body so as to transmit a vertical movement of a sewing machine needle to the movable blade; the movable blade being fixed to a lower front end portion of the link frame to cut cloth in cooperation with the fixed blade; the frame body having a holder coupling section to be detachably engaged with a holder and fixed to the sewing machine.

The side cutter for a sewing machine is also characterized in that the holder coupling section has a pair of guides standing on each side respectively and a supporting rod extended between front end portions of the guides and that the holder coupling section is located under the frame body.

The side cutter for a sewing machine is also characterized in that the link frame is attached to the frame body through a spring washer.

The side cutter for a sewing machine is also characterized in that the movable blade is fixed to a front lower end portion of the link frame through a spring washer.

Other aspects and advantages of the invention will become apparent from the following description, taken in conjunction with the accompanying drawings illustrating by way of examples the principles of the invention.

BRIEF DESCRIPTION OF THE DRAWING

The invention together with the objects and advantages thereof, may best be understood by reference to the following description of the presently preferred embodiments together with the accompanying drawings in which:

FIG. 6 is a front view of the prior art side cutter for a sewing machine; and FIG. 7 is a perspective view showing a part of the side cutter shown in FIG. 6.

DETAILED DESCRIPTION OF THE PREFERRED EMBODIMENT

Figure 1:
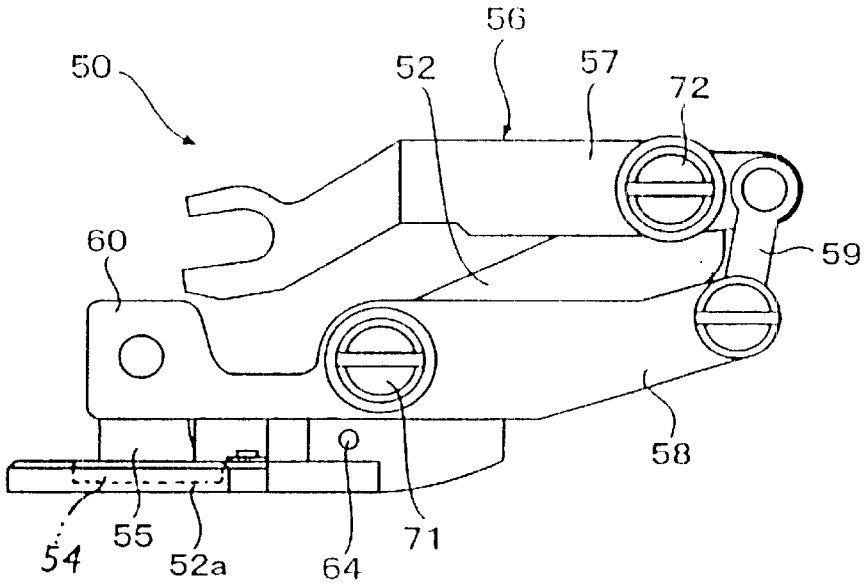
FIG. 1 is a front view of the side cutter according to an embodiment of the present invention.
Figure 2:
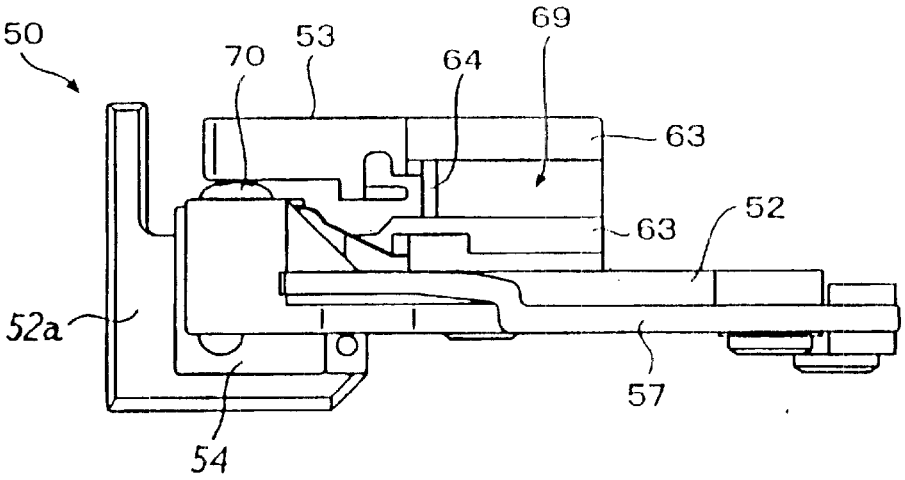
FIG. 2 is a plan view of the side cutter shown in FIG. 1.
Figure 3:
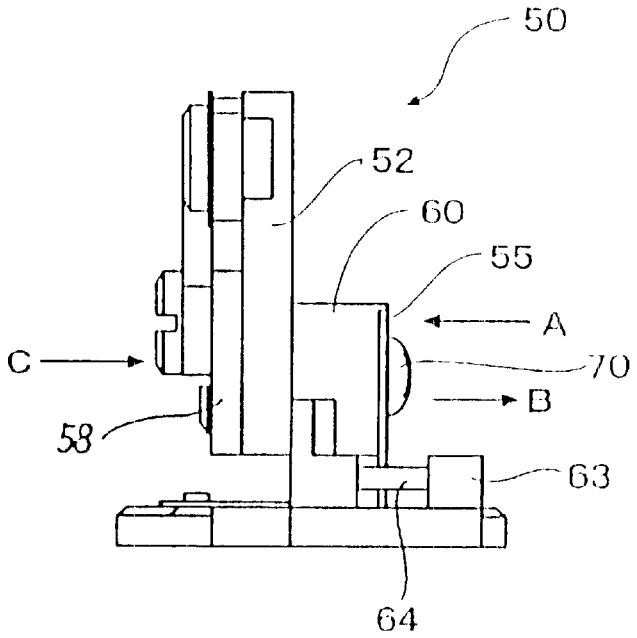
FIG. 3 is a right side view of the side cutter shown in FIG. 1.
Figure 4:
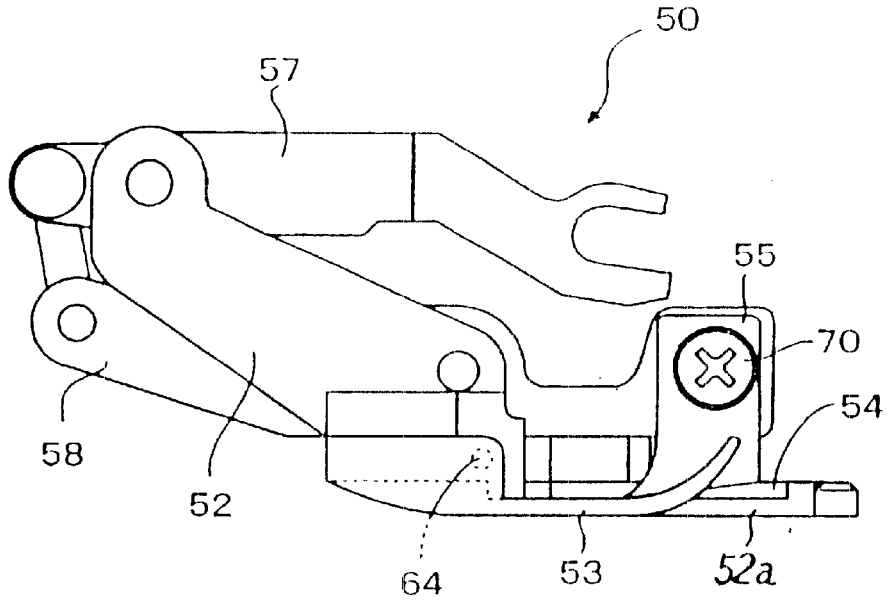
FIG. 4 is a rear view of the side cutter shown in FIG. 1.
Figure 5:
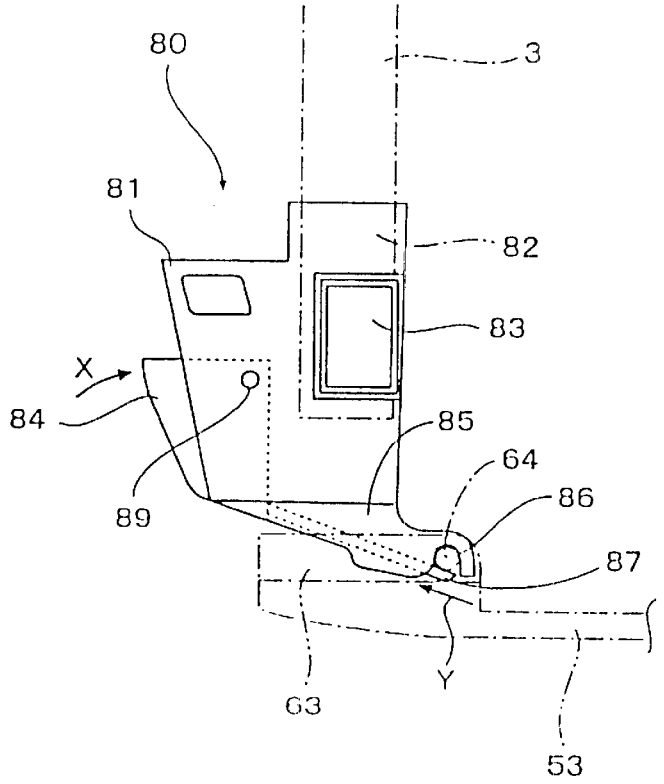
FIG. 5 is a front view of the holder to be fixed to a presser bar of a sewing machine.
Figure 5:
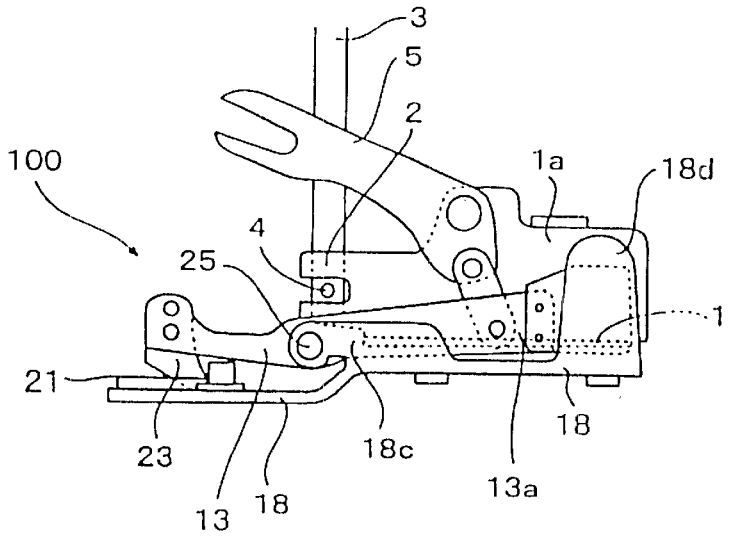

FIGS. 1 to 5 show a side cutter for a sewing machine according to one embodiment of the present invention, in which FIG. 1 is a front view of the side cutter, FIG. 2 a plan view thereof, FIG. 3 a right side view thereof, FIG. 4 a rear view thereof, and FIG. 5 is a front view of a holder to be fixed to a presser bar of the sewing machine.

The side cutter 50 for a sewing machine according to this embodiment has a frame body 52 located at a center thereof, a holder coupling section 69 formed under the frame body 52 integrally therewith and a presser foot 53 located at the front end of the holder coupling section 69. The holder-coupling section 69 has a pair of guides 63 rising from each side thereof respectively, and a supporting rod 64 extended between front end portions of the guides 63.

The holder coupling section 69 is used when the side cutter 50 is attached to a sewing machine and is designed to have a configuration enabling engagement of the side cutter 50 with a holder to be detachably fixed to a presser bar of the sewing machine.

FIG. 5 shows an example of the holder to be fixed to a sewing machine.

The holder 80 consists essentially of a fixing section 81 to be fixed to a presser bar 3 of the sewing machine and a coupling section 85 formed at the bottom of the fixing section 81 integrally therewith, which section 85 is to be engaged with the holder coupling section 69.

The fixing section 81 contains a press bar holding hole 82 in which the presser bar 3 of the sewing machine is held and immobilized. Engagement of the presser bar 3 with the holding hole 82 and disengagement therefrom can be achieved by pressing a button 83 located on a lateral side of the fixing section 81.

The coupling section 85 has a front end protruding forward of the fixing section 81 and having a groove 86. A pin 87 is located at the lower edge of the groove 86. This pin 87 is designed to be able to advance and retract to and from the groove 86 by operating a pressing piece 84 located at the rear side of the fixing section 81.

The side cutter 50 is provided with cutter having a fixed blade (lower blade) 54 and a movable blade (upper blade) 55.

The fixed blade 54 of the cutter is located beside the presser foot 53 and is fixed to abase plate 52*a* formed integrally with the frame body 52. Meanwhile, a drive mechanism is formed by connecting, to the frame body 52, an input link 57 and a seesaw link 58 as link frames 56 to be able to swing vertically and by linking the input link 57 and the seesaw link 58 to each other with an intermediate link 59. The seesaw link 58 has at the front end thereof a bracket 60 by which the movable blade 55 of the cutter is supported.

The movable blade 55 is screwed onto the bracket 60 through a spring washer 70, so that the blade 55 is constantly urged in the direction A as shown in FIG. 3.

Meanwhile, the seesaw link 58 is screwed onto the frame body 52 through a spring washer 71, so that the link 58 is constantly urged in the direction C.

Further, the input link 57 is screwed onto the frame body 52 through a spring washer 72, and thus crosswise run-out of the link 57 is prevented.

Next, actions of the embodiment will be described.

When the side cutter 50 for a sewing machine according to this embodiment is used, it is attached to the holder 80, to be detachably fixed to a sewing machine, by engaging the holder coupling section 69 of the side cutter 50 with the coupling section 85 of the holder 80 before starting sewing.

The manner of fixing the holder 80 to a sewing machine will be described referring to FIG. 5.

The coupling section 85 is inserted to the holder coupling section 69 of the side cutter 50, and the pressing piece 84 of the fixing section 81 is pressed in the direction X (see FIG. 5). Thus, the pressing piece 84 pivots on a shaft 89 against the resilience of an internal spring (not shown) to cause the pin 87 to retract in the direction Y and admit the supporting rod 64 into the groove 86.

The pressing piece 84 is then released from the pressure, and it turns automatically to the original position under the resilience of the internal spring. Meanwhile, the pin 87 interlocking with the pressing piece 84 advances toward the groove 86 to resume the state as shown in FIG. 5 and support the supporting rod 64.

Subsequently, the presser bar 3 of the sewing machine is inserted to the holding hole 82 of the holder 80 by operating the button 83 of the fixing section 81. Thus, the holder 80 is attached to the sewing machine.

In carrying out sewing of cloth, it is sewn as it is fed forward under pressure of the presser foot 53, while it is cut by the fixed blade 54 and the movable blade 55.

Here, the movable blade 55 is urged constantly in the direction A, since it is screwed onto the bracket 60 through the spring washer 70.

In other words, the movable blade 55 descends while it is urged toward the fixed blade 54 and cuts the cloth. When the cloth is cut, it interposes between the movable blade and the fixed blade to repel the movable blade 55 in the direction B (see FIG. 3) by the thickness of the cloth. However, under the action of the spring washer 70, the movable blade 55 can shift in the direction B by a very small distance of about 0.2 to 0.3 mm, so that the movable blade 55 can release the force in the direction B applied thereto by the cloth during cutting.

This can prevent occurrence of damage including cracking of the movable blade 55. Moreover, since the movable blade 55 and the fixed blade 54 can cut the cloth with a constant force while they constantly maintain point contact with respect to each other, they enable the sewing machine to carry out efficient and accurate sewing.

Meanwhile, the seesaw link 58 is screwed onto the frame body 52, while it is urged constantly in the direction C under the action of the spring washer 71. This maintains the movable blade 55 attached to the front end of seesaw link 58 constantly and stably in position. Further, the movable blade 55 can behave suitably, under the action of the spring washer 71, in cutting the cloth depending on the thickness thereof, so that the seesaw link 58 serves to securely maintain the point contact between the movable blade 55 and the fixed blade 54 in cooperation with the action of the spring washer 70.

The side cutter 50 can be attached and detached to and from a sewing machine through one-touch operation by engaging the holder coupling section 69 with the coupling section 85 of the holder 80. This dispenses with the thumbscrew as used in the prior art for fixing the side cutter to the presser bar of the sewing machine body and enables easy and speedy attaching and detaching of the side cutter to and from the sewing machine.

In the present invention, since the movable blade is fixed through a spring washer, it shifts aside slightly in the horizontal direction when cutting cloth to release the force to be applied from the cloth horizontally to the movable blade, maintaining constantly and stably point contact with the fixed blade. Thus, the side cutter enables a sewing machine to carry out secured cutting of cloth, irrespective of its thickness and hem stitching of the cloth.

Moreover, since the holder coupling section of the side cutter enables attaching and detaching of the side cutter to and from a sewing machine through one-touch operation with the aid of the holder, the present invention exhibits improved working efficiency etc.

The side cutter of the present invention has a reduced number of parts compared with the prior art, and thus it exhibits not only reduction in and weight but also reduction of the number of manufacturing steps, leading to cost savings.

It should be apparent to those skilled in the art that the present invention may be embodied in many other specific forms without departing from the spirit or scope of the invention.

What is claimed is:

1. A side cutter for a sewing machine, the side cutter comprising:

a frame body;

a fixed blade located in front of the frame body;

a link frame attached to the frame body; and a movable blade fixed to a lower front end portion of the link frame to cut cloth in cooperation with the fixed blade, said link frame being attached to said frame body so as to transmit a vertical movement of a sewing machine needle to the movable blade;

wherein the frame body has a holder coupling section to be detachably engaged with a holder and fixed to the sewing machine; and wherein the holder coupling section comprises a pair of guides standing on each side respectively and a supporting rod extended between front end portions of the guides, and the holder coupling section is located under the frame body.

2. The side cutter for a sewing machine according to claim 1, wherein the link frame is attached to the frame body through a spring washer.

3. The side cutter for a sewing machine according to claim 1, wherein the movable blade is fixed to a front lower end portion of the link frame through a spring washer.

4. A side cutter for a sewing machine, the side cutter comprising:

a frame body;

a fixed blade located in front of the frame body;

a link frame attached to the frame body; and a movable blade fixed to a lower front end portion of the link frame to cut cloth in cooperation with the fixed blade, said link frame being attached to said frame body so as to transmit a vertical movement of a sewing machine needle to the movable blade;

wherein the frame body has a holder coupling section to be detachably engaged with a holder and fixed to the sewing machine; and wherein the link frame is attached to the frame body through a spring washer.

5. A side cutter for a sewing machine, the side cutter comprising:

a frame body;

a fixed blade located in front of the frame body;

a link frame attached to the frame body; and a movable blade fixed to a lower front end portion of the link frame to cut cloth in cooperation with the fixed blade, said link frame being attached to said frame body so as to transmit a vertical movement of a sewing machine needle to the movable blade;

wherein the frame body has a holder coupling section to be detachable engaged with a holder and fixed to the sewing machine; and wherein the movable blade is fixed to a front lower end portion of the link frame through a spring washer.

* * * * *